US008774690B2

(12) United States Patent
Williams et al.

(10) Patent No.: US 8,774,690 B2
(45) Date of Patent: Jul. 8, 2014

(54) APPARATUS, METHOD AND SYSTEM FOR CONTROLLING BULGE RADIUS OF A PRESSURE MEMBER

(75) Inventors: Stephen Bradley Williams, Marion, NY (US); Steven Matthew Russel, Bloomfield, NY (US); Lawrence Arnold Clark, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 112 days.

(21) Appl. No.: 13/495,090

(22) Filed: Jun. 13, 2012

(65) Prior Publication Data

US 2013/0336682 A1 Dec. 19, 2013

(51) Int. Cl.
*G03G 15/20* (2006.01)

(52) U.S. Cl.
USPC ..... 399/323; 399/107; 399/329

(58) Field of Classification Search
USPC ..... 399/107, 122, 323, 329
See application file for complete search history.

(56) References Cited

U.S. PATENT DOCUMENTS

| | | | | |
|---|---|---|---|---|
| 7,715,772 | B2 * | 5/2010 | Ko | 399/323 |
| 2005/0220507 | A1 * | 10/2005 | Uehara et al. | 399/329 |
| 2010/0189477 | A1 * | 7/2010 | Yamada | 399/329 |
| 2010/0226700 | A1 * | 9/2010 | Yamada et al. | 399/329 |
| 2011/0081173 | A1 * | 4/2011 | Watanabe et al. | 399/323 |

* cited by examiner

*Primary Examiner* — David Gray
*Assistant Examiner* — Francis Gray
(74) *Attorney, Agent, or Firm* — Ronald E. Prass, Jr.; Prass LLP

(57) ABSTRACT

An apparatus, system and method are provided for controlling a bulge radius of a pressure member in a belt-roll fuser. The belt-roll fuser has a first pressure member. The belt-roll fuser also has a fuser belt having a portion that faces a surface of the first pressure member at a region defining a fusing nip. The belt-roll fuser further has a second pressure member that faces another portion of the fuser belt at the fusing nip such that the fuser belt is entrained between the first pressure member and the second pressure member. The belt-roll fuser additionally has a deformation member configured to deform the first pressure member.

20 Claims, 7 Drawing Sheets

APPARATUS, METHOD AND SYSTEM FOR CONTROLLING BULGE RADIUS OF A PRESSURE MEMBER

FIELD OF DISCLOSURE

The disclosure relates to belt-roll fuser apparatuses, methods and systems useful in printing. Specifically, the disclosure relates to a belt-roll fuser that maintains a nip pressure profile at a fusing nip by way of a controlled deformation that also causes effective stripping.

BACKGROUND

Conventional belt-roll fusers include an internal pressure roll ("IPR"), which entrains a fuser belt, and an external pressure roll ("EPR"). A fusing nip is conventionally defined by a region under pressure between the EPR and the IPR. Conventional belt-roll fusers utilize a hard IPR and a soft EPR to form a fusing nip for fusing an image to a substrate that has just received toner from a transfer station. See FIG. 1 for an example of a related art belt-roll fuser architecture.

Conventional belt-roll fusers often have a stripping shoe that is used to load an inner side of the fusing belt to generate an effective fusing nip pressure in a region beyond the region under pressure between the EPR and the IPR. While the stripping shoe may help generate an effective fusing nip pressure, belt-roll fusers that utilize conventional IPR and EPR architecture with a stripping shoe still often face image related defects such as, but not limited to, gloss related image quality ("IQ") defects, stripping performance, and failure to demonstrate process latitude. These issues are caused by a variance in pressure in the fusing nip that result because of the stripping shoe. Maintenance costs may also be increased by the presence of the stripping shoe because of wear that the stripping shoe may experience or cause on the fuser belt, thereby requiring frequent repair and/or replacement.

SUMMARY

Apparatuses, methods and systems for use in printing are disclosed. Various exemplary embodiments improve image quality performance of belt-roll fusers by maintaining an effective nip pressure profile at the fusing nip at least by way of a controlled deformation. In some embodiments, the deformation may be provided in lieu of the stripping shoe.

According to one embodiment, an apparatus useful in printing comprises a first pressure member. The apparatus further comprises a fuser belt having a portion that faces a surface of the first pressure member at a region defining a fusing nip. The apparatus also comprises a second pressure member that faces another portion of the fuser belt at the fusing nip such that the fuser belt is entrained between the first pressure member and the second pressure member. The apparatus additionally comprises a deformation member configured to deform the first pressure member.

According to another embodiment, a method for stripping a substrate from a fuser belt comprises defining a fusing nip in an apparatus comprising a first pressure member, a fuser belt having a portion that faces a surface of the first pressure member at the fusing nip, a second pressure member that faces another portion of the fuser belt at the fusing nip such that the fuser belt is entrained between the first pressure member and the second pressure member, and a deformation member configured to deform the first pressure member. The method further comprises causing, at least in part, the deformation member to induce a predetermined deformation in the first pressure member. The method also comprises causing, at least in part, stripping of a substrate from the fuser belt.

According to another embodiment, a system useful in printing configured to strip a substrate comprises a first pressure member. The system also comprises a fuser belt having a portion that faces a surface of the first pressure member at the fusing nip. The system further comprises a second pressure member that faces another portion of the fuser belt at the fusing nip such that the fuser belt is entrained between the first pressure member and the second pressure member. The system additionally comprises a deformation member configured to deform the first pressure member. The substrate may be stripped from the fuser belt at a position downstream of the fusing nip in a process direction.

Exemplary embodiments are described herein. It is envisioned, however, that any system that incorporates features of any apparatus, method and/or system described herein are encompassed by the scope and spirit of the exemplary embodiments.

DETAILED DESCRIPTION

Figure 1:
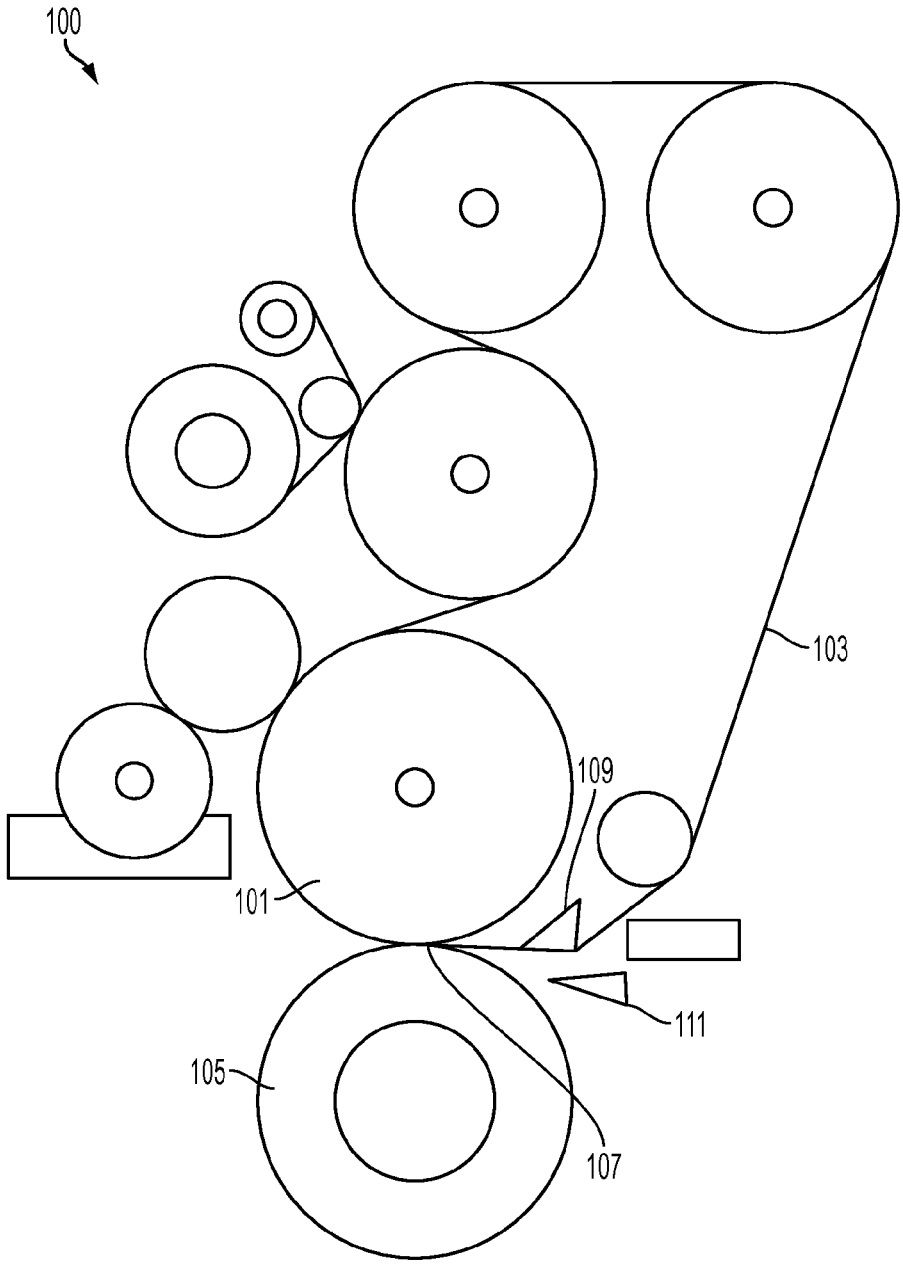
FIG. 1 RELATED ART
FIG. 1 is a diagrammatical side view of a related art belt-roll fuser.

Exemplary embodiments are intended to cover all alternatives, modifications and equivalents as may be included within the spirit and scope of the apparatuses, methods and systems as described herein. Reference is made to the drawings to accommodate understanding of disclosed apparatuses, methods and systems useful in printing. In the drawings, like reference numerals are used throughout to designate similar or identical elements. The drawings depict various embodiments related to embodiments of illustrative apparatuses, methods and systems for maintaining a nip pressure profile in a fusing nip by way of a controlled deformation to cause effective stripping.

Apparatuses and systems of embodiments may include systems for printing images on media by fusing marking material to a substrate using a belt-roll fuser.

FIG. 1 illustrates a diagrammatical side view of an example related art belt-roll fuser 100. Conventional belt-roll fusers utilize a hard IPR 101, which entrains a fuser belt 103, and a soft EPR 105. The IPR 101, fuser belt 103 and EPR 105 form a fusing nip 107 for fusing an image to a substrate that has just received toner from a transfer station.

The substrate may be any form of media upon which marking material, such as toner, may be deposited. The substrate may be fed by the belt-roll fuser 100 through the fusing nip 107 in a process direction from a nip entrance to a nip exit. The belt-roll fuser 100 may then be configured to apply, e.g., pressure and heat at the fusing nip 107 to fuse a marking material to the substrate.

The fuser belt 103 may be entrained by one or more components of the belt-roll fuser 100. For example, the fuser belt 103 may have a first side and a second side. The first side, for example, may be an inner side that contacts the IPR 101, and may also contact other members of the belt-roll fuser 100 that may entrain the fuser belt 103. The second side may contact a substrate that passes through the fusing nip 107.

Belt-roll fusers that utilize conventional IPR and EPR architecture such as that illustrated in FIG. 1 often face image related defects such as, but not limited to, gloss related IQ defects, stripping performance, and failure to demonstrate process latitude. These issues may be due to variability in fusing nip geometry caused by variables such as IPR and/or EPR elastomer bulge, temperature variation, shoe location, and inboard to outboard nip dynamics.

To help with the aforementioned image related defects, the related art belt-roll fuser 100 illustrated in FIG. 1 uses a strip shoe 109 to load the fuser belt 103 and aid in stripping of a substrate from the fuser belt 103. The belt-roll fuser 100 also uses an air knife 111 to aid in stripping the substrate from the fuser belt 103. Paper tends to stick to the fuser belt 103 after passing through the fusing nip 107. The strip shoe 109 provides a small (<5 mm) stripping radius such that the paper will peel away from the fuser belt 103. However, because the fuser belt 103 wraps around the outside of the strip shoe 109, the related art belt-roll fuser 100 design results in a fusing nip 107 that has three different zones. These three different zones result in varying nip pressure throughout the fusing nip 107 and cause inconsistent stripping performance, which in turn causes the above-mentioned image-related defects. The presence of the strip shoe 109 also increases maintenance costs because it may cause wear on various components of the belt-roll fuser 100, such as fuser belt 103. These features, accordingly, may require frequent repair and/or replacement. The strip shoe 109 itself may also wear and require repair and/or replacement as well.

Figure 2:
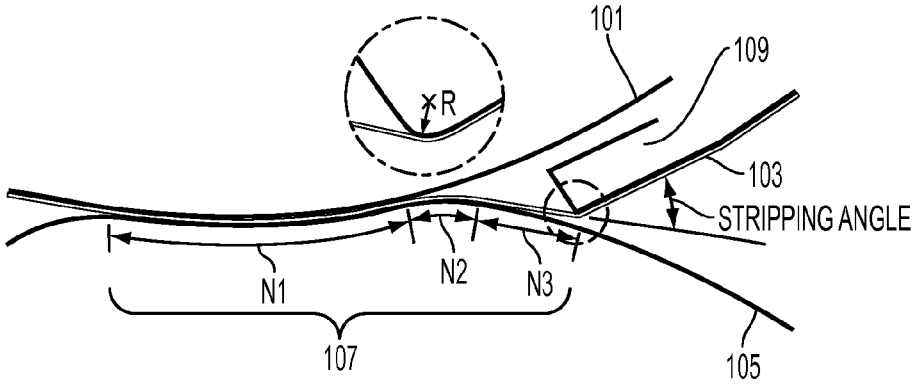
FIG. 2 RELATED ART
FIG. 2 is a diagrammatical side view of a fusing nip of a related art belt-roll fuser.

FIG. 2 illustrates a diagrammatical side view of the geometry of the fusing nip 107, as discussed above. The fusing nip 107 is divided into three zones caused by conventional dual-roll architecture and the presence of the strip shoe 109. First, a primary, high-pressure, fusing nip (N1) is defined by a region generated by the interference of the IPR 101 and the EPR 105. Second, a low pressure contact nip (N2) is defined by a region in which the fuser belt 103 is in contact with the EPR 105 and not in contact with the IPR 101. Third, a free span (N3) is defined by a region between N2 and the strip shoe 109 where the fuser belt 103 is not in contact with either the IPR 101 or the EPR 105.

This three-nip geometry results in varying nip pressure throughout the fusing nip 107 and causes inconsistent stripping performance, which in turn causes the above-mentioned image-related defects. For example, the unsupported free span N3 may be one of the causes of image gloss defects. As the lead edge of a substrate travels through N2, substrates such as heavyweight sheets, for example, often do not conform to the shape of the EPR 105 with only belt tension producing a downward force (pressure in N2 may be less than 10 psi, for example). The downward force is only produced by belt tension in N2 in this example because the fuser belt 103 is no longer in contact with the IPR 101. Due to the beam strength of the sheet, separation and subsequent reattachment of the sheet to the belt may occur in zone N2, resulting in a gloss defect called "icicles."

Additionally, for example, depending on the density and location of an image, a substrate can stick to the fuser belt 103 or to the EPR 105 as it travels through the free span N3. The substrate may separate from and retouch the fuser belt 103 in the free span N3 causing image quality defects known as "retack."

It is difficult to orient the strip shoe 109 to eliminate the N2 and N3 regions. The N2 and N3 regions, as discussed above are caused by variances in pressure in the fusing nip 107. While the strip shoe 109 may be positioned to optimize stripping performance and minimize the image defects, its positioning is difficult to perfect because of thermal expansion that may occur in the IPR 101, the EPR 105 and/or the fuser belt 103, as well as uncontrolled bulges that occur in the IPR 101 and/or the EPR 105 beyond the fusing nip 107. It is further difficult to perfectly place the strip shoe 109 because of various wearing that may occur on any of the IPR 101, EPR 105, fuser belt 103 and strip shoe 109, as well as changes in durometer of the IPR 101 and/or the EPR 105.

Despite the variance in pressure that occurs between N1 and N2, certain substrates perform well in a long N2 region. Making the N2 region too short can cause stripping issues that result in the some of the image quality issues discussed above, as well as others. Accordingly, there is a need for a fuser system that provides reliable stripping performance without the need for a strip shoe 109 while effectively driving the N3 region to zero by controlling nip geometry.

Figure 3:
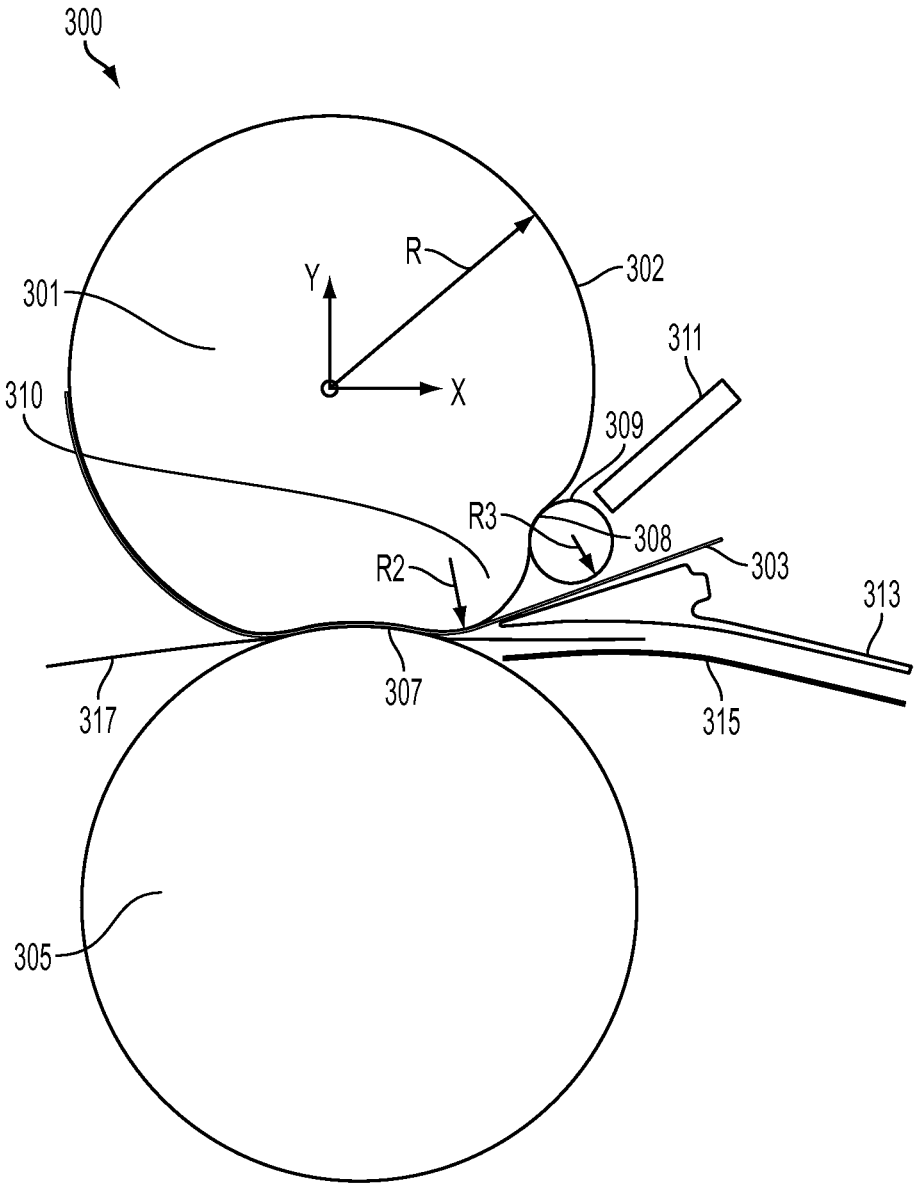
FIG. 3 is a diagrammatical side view of a belt-roll fuser having a pressure member in contact with a deformation enhancing member, according to one example embodiment.

FIG. 3 illustrates a diagrammatical side view of a belt-roll fuser 300 that controls nip geometry to affect image quality and stripping performance, according to one embodiment. The nip geometry, as discussed in more detail below, is controlled by inducing a deformation in a pressure member that forms a customizable stripping radius.

The belt-roll fuser 300 includes a pressure member such as IPR 301 that entrains a fuser belt 303. IPR 301, in this example, may be a drum or roll that is rotatable about its longitudinal axis. The IPR 301 may comprise any elastomer material, rubber, polymer and/or metal. The belt-roll fuser 300 further includes another pressure member such as EPR 305. EPR 305 may comprise any elastomer material, rubber, polymer, and/or metal. The EPR 305 may be configured to deform an amount that is less than or equal to an amount of deformation that the IPR 301 may be configured to deform under an equal pressure. In at least one embodiment, the IPR 301 may be configured to deform under a predetermined pressure while the EPR 305 may be configured to remain fixed under the same predetermined pressure.

The IPR 301, fuser belt 303, and EPR 305 define a fusing nip 307 in a region at which the IPR 301 and the fuser belt 303 are in contact with one another, and the EPR 305 and the fuser belt 303 are in contact with one another. In the fusing nip 307, the IPR 301 may be configured to deform so that an exterior surface of the IPR 301 conforms to the shape of an exterior surface of the EPR 305. Pressure may then be uniformly applied throughout the fusing nip 307 in a region in which the fuser belt is in contact with the IPR 301 and the EPR 305. Accordingly, in this region, the uniform pressure may be applied to the fuser belt 303 and any media that may also pass through the fusing nip 307 in a process direction. This region may be considered to correspond to at least the N1 region discussed above with respect to FIG. 2.

According to one example embodiment, the belt-roll fuser 300 may include a deformation enhancing member such as bulge enhancing roll 309 that may rotate about its longitudinal axis to induce a deformation 310 of the IPR 301. The IPR 301, in this example, is a roll that has an exterior surface 302 having a radius R. To reduce or eliminate the N3 region discussed above with regard to FIG. 2, the radius R of the exterior surface 302 of IPR 301 is altered by the deformation 310 such that the exterior surface 302 of IPR 301 has a stripping radius R2 formed upstream of the bulge enhancing roll 309 in the process direction. The magnitude of stripping radius R2, according to various embodiments, may be less than the magnitude of radius R. In one or more embodiments, the radius R2 may be less than 5 mm, for example. To cause the deformation, a radius R3 of bulge enhancing roll 309 may be less than, equal to, or greater than the radius R of the IPR 301. The difference in radius may be dependent on a size of the deformation 310 that is desired, the magnitude of radius R2 that results, pressure constraints, and space constraints in the belt-roll fuser 300, for example.

According to various embodiments, the bulge enhancing roll 309 may be comprised of any elastomer material, rubber, polymer and/or metal. The bulge enhancing roll 309, so as to induce the deformation 310, may be configured to deform less than an amount that the IPR 301 may deform under a predetermined pressure, or not at all. When causing the deformation 310, a region at which the bulge enhancing roll 309 contacts the IPR 301 defines a deformation nip 308.

According to various embodiments, the bulge enhancing roll 309 and the IPR 301 may be in a fixed position such that a degree of deformation 310 is constant with the exception of any variance caused by thermal expansion of the IPR 301 and the bulge enhancing roll 309, for example.

According to various example embodiments, the bulge enhancing roll 309 may alternatively be movable to control the degree of deformation 310, i.e. the magnitude of stripping radius R2, on demand. The magnitude of the stripping radius R2 may have an effect on the stripping performance of the belt-roll fuser 300 which could vary based on substrate type, substrate weight, and/or weather conditions such as temperature and humidity, for example. Accordingly, a deformation control member 311 may cause the bulge enhancing roll 309 to change position from a first position to a second position, for example, to apply varying pressure in the deformation nip 308 so as to alter the degree of deformation 310.

The deformation control member 311 may be any of, for example, a spring actuated system that causes the bulge enhancing roll 309 to apply pressure at the deformation nip 308, a pneumatic device that causes the bulge enhancing roll 309 to apply pressure at the deformation nip 308, or any other device that enables the bulge enhancing roll 309 to apply a predetermined pressure at the deformation nip 308.

Additionally, the variance in position of the bulge enhancing roll 309 may also allow for different belt sizes of the fuser belt 303 to be accommodated. For example, thicker or thinner belts may be used in the belt-roll fuser 300 for different print job requirements, varying performance requirements such as printer speed, or to accommodate heavier or lighter substrates, as well as to account for thermal expansion of the components of the belt-roll fuser 300 such as the IPR 301 and/or the EPR 305. To accommodate expansion of the IPR 301, a thinner fuser belt 303 may be used in the belt-roll fuser 300 to help maintain a predetermined stripping radius R2. However, because belt sizes may vary, and availability may be limited, the magnitude of the deformation 310 could be controlled by the deformation control member 311 so that regardless of the size of belt that is available, the predetermined stripping radius R2 may be maintained.

Additionally, altering the magnitude of deformation 310 to an optimal stripping radius R2 may allow for a reduction in the necessary thickness of fuser belt 303, as well as any coating thereon. Such a reduction in thickness may have an effect on the performance of the belt-roll fuser 300 such as improving image quality and consistency. A thinner coating, for example, would effectively reduce an amount of possible deformation that could occur to the fuser belt 303 as a result of pressure in the fusing nip 307, or any thermal expansion the fuser belt 303 could experience in the fusing nip 307.

Alternatively, or in addition to the bulge enhancing roll 309 being movable, the IPR 301 may be adjustable, along with other components of the belt-roll fuser 300 to adjust the magnitude of deformation 310 in the same manner as discussed above to apply the predetermined pressure at the deformation nip 308.

In one or more embodiments, the bulge enhancing roll 309, may be configured to contact or not contact the fuser belt 303. In various embodiments, the bulge enhancing roll 309 may be configured to additionally perform maintenance functions such as cleaning and/or conditioning one or more of the IPR 301 and the fuser belt 303.

In one or more embodiments, while the deformation 310 is controlled to reduce or eliminate the region N3 discussed above to improve stripping performance, and the substrate 317 may strip at an optimal moment on its own, the belt-roll fuser 300 may further include an air knife 313 and an exit baffle 315 to aid in stripping the substrate 317 from the fuser belt 303. The exit baffle 315 may also guide the substrate as it progresses through the fusing nip 307 in the process direction. For example, should the substrate 317 stick to the fuser belt 303, the air knife 313 may cause the substrate 317 to separate from the fuser belt. Further, the exit baffle 315 may prevent early, or too much, separation from the fuser belt 303, thereby aiding in a reduction of at least the image defects discussed above.

Figure 4:
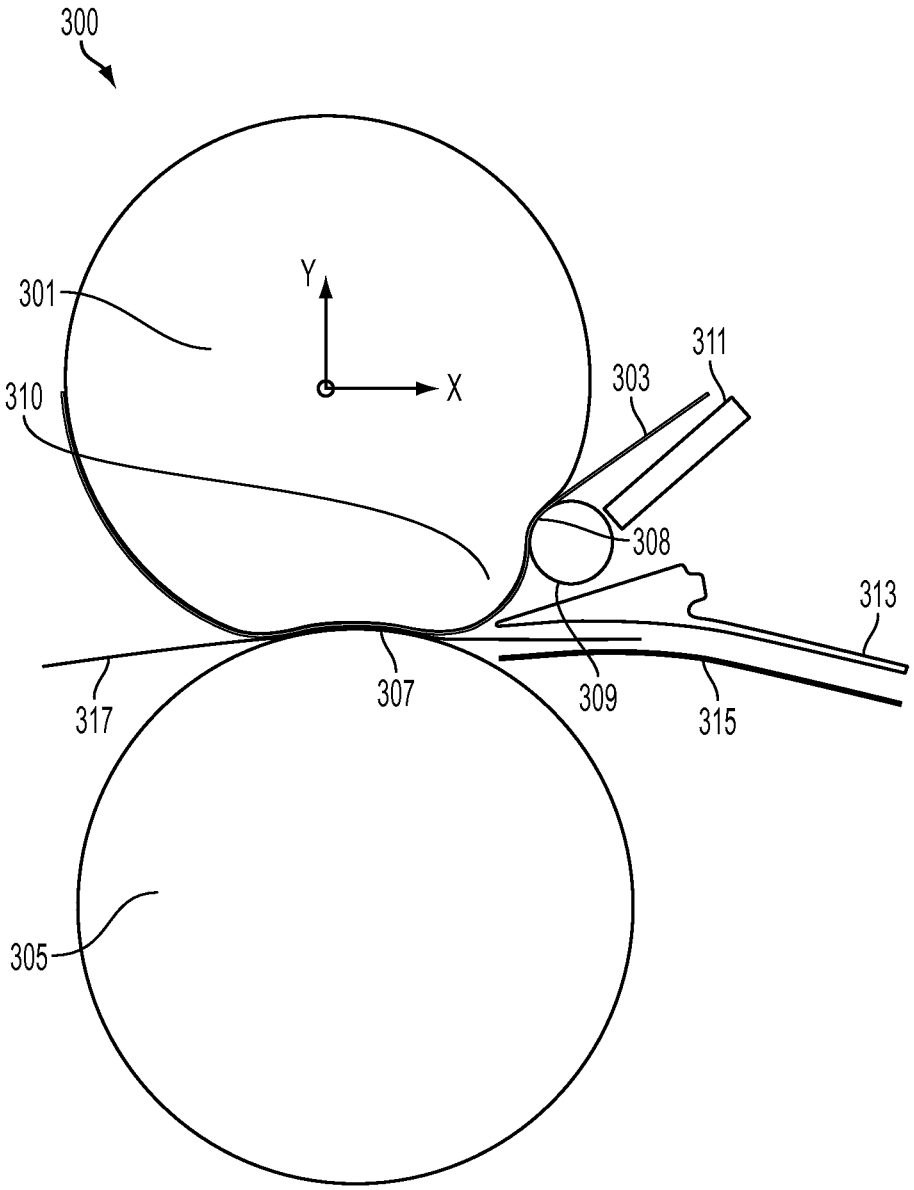
FIG. 4 is a diagrammatical side view of a belt-roll fuser having a fuser belt entrained between a pressure member and a deformation enhancing member, according to one example embodiment.

FIG. 4 illustrates a diagrammatical side view of the belt-roll fuser 300 discussed above with reference to FIG. 3, according to another embodiment. The belt-roll fuser 300, in this example, has the fuser belt 303 entrained between the IPR 301 and the bulge enhancing roll 309 through the deformation nip 308. The fuser belt 303 may be caused to pass in this region so that, for example, space may be saved inside of the belt-roll fuser 300. Also as discussed above, the bulge enhancing roll 309, because it is in contact with a portion of the fuser belt 303 that is opposite a portion of the fuser belt 303 that is in contact with the IPR 301 (i.e. the outside of the fuser belt 303), may be configured to apply a maintenance conditioner, such as oil or other lubricant, to the outside of the fuser belt 303, and may also act as a cleaning device for the outside of the fuser belt.

Figure 5:
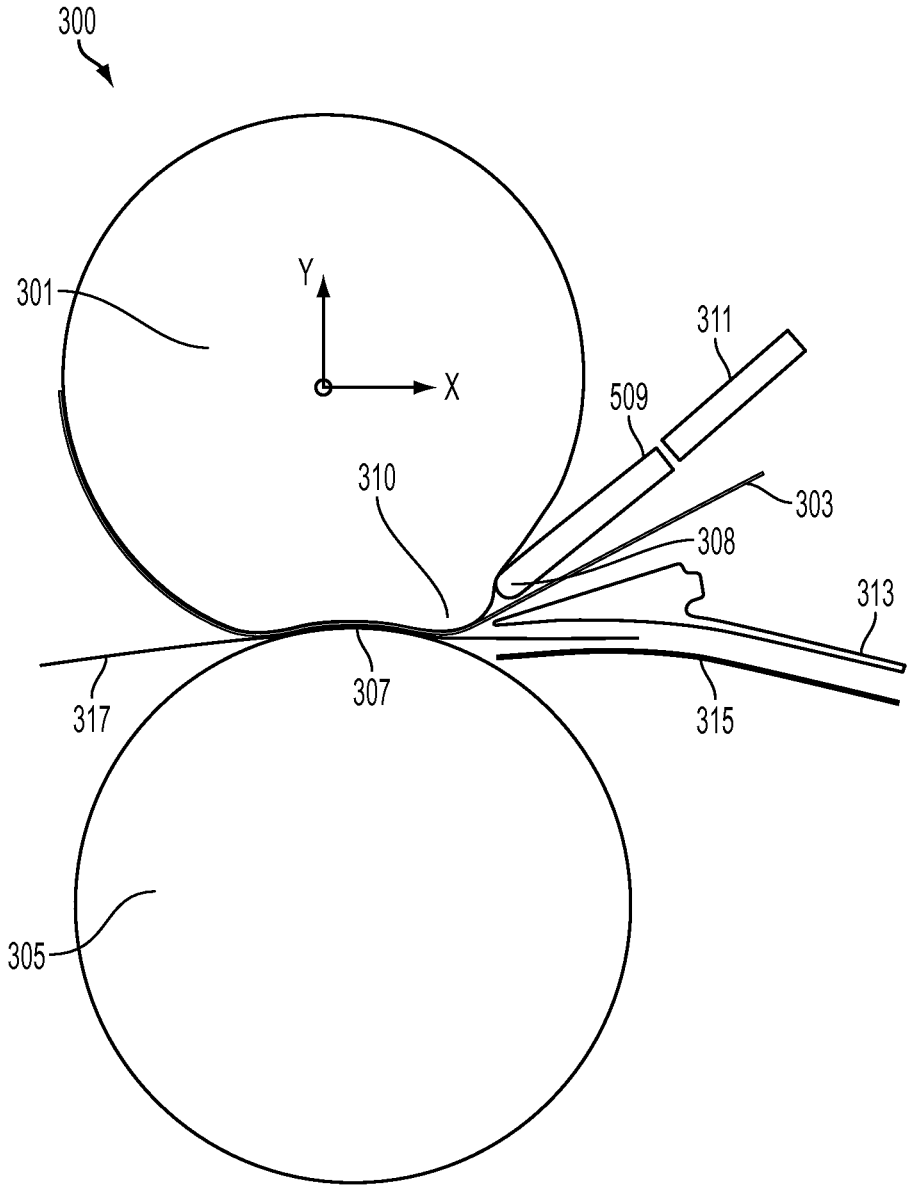
FIG. 5 is a diagrammatical side view of a belt-roll fuser having a deformation enhancing member that is a shoe, according to one example embodiment.

FIG. 5 illustrates a diagrammatical side view of the belt-roll fuser 300 discussed above with reference to FIG. 3, according to another embodiment. The belt-roll fuser 300, in this example, replaces the bulge enhancing roll 309 with a bulge enhancing shoe 509. The bulge enhancing shoe 509, like the bulge enhancing roll 309 discussed above, may be fixed or movable to cause the deformation 310. The bulge enhancing shoe 509 may include any of an elastomer material, rubber, polymer, metal, or any combination thereof. The bulge enhancing shoe 509, because it forms a deformation nip 308 with the IPR 301 and is in direct contact with the IPR 301, may be coated with a friction resistant coating such at Teflon to reduce wear on the IPR 301 and/or the bulge enhancing shoe 509.

In this example, the fuser belt 303 is tracked so that it does not pass through the deformation nip 308. This is because the bulge enhancing shoe 509 does not rotate about a longitudinal axis like the bulge enhancing roll 309. Because the bulge enhancing shoe 509 does not rotate, this may cause undo stress and/or wear on the fuser belt 303. However, in view of the friction resistant coating on the bulge enhancing shoe, the fuser belt 303 could optionally be entrained between the IPR 301 and the bulge enhancing shoe 509 to save space inside the belt-roll fuser 300, as well as to clean or provide a maintenance conditioner to the fuser belt, as discussed above.

Figure 6:
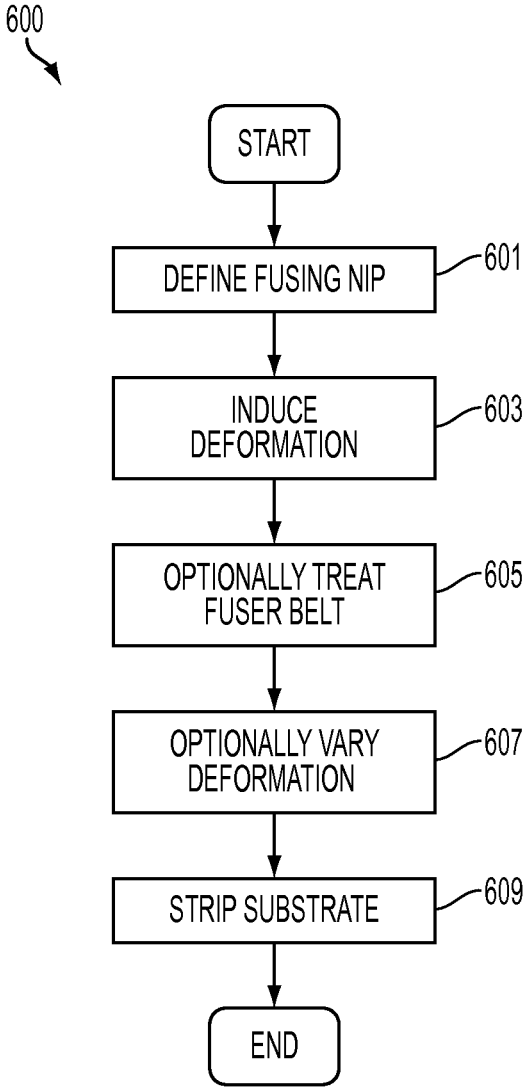
FIG. 6 is a flowchart of a process for stripping a substrate from a fuser belt, according to one example embodiment.
Figure 7:
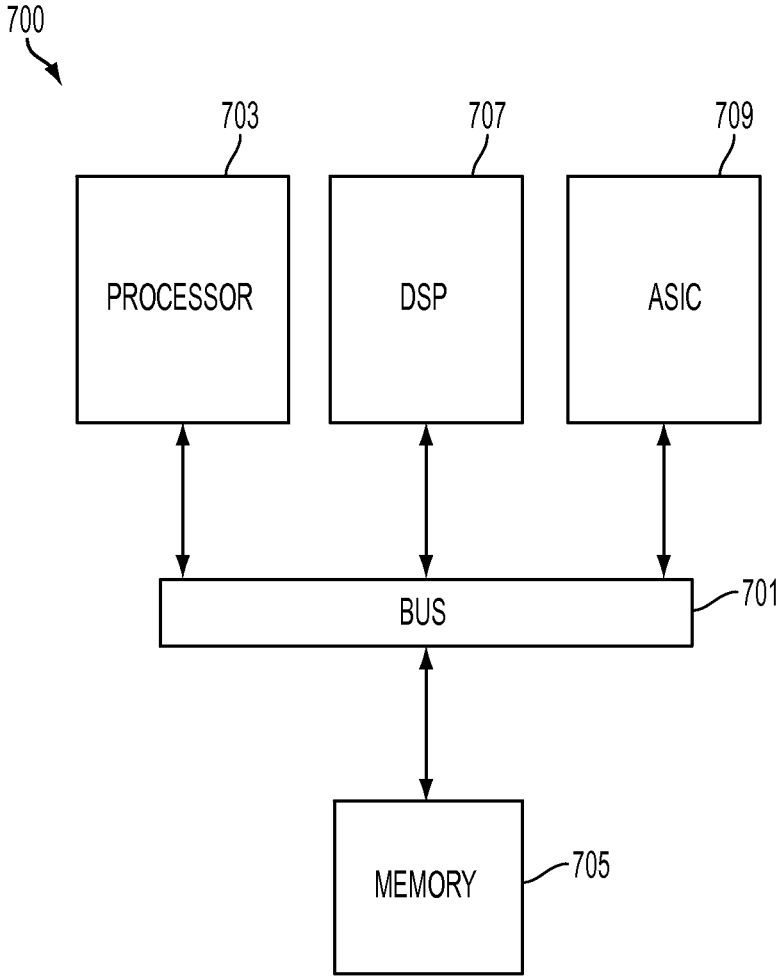
FIG. 7 is a diagram of a chip set that can be used to implement an example embodiment.

FIG. 6 is a flowchart of a process for stripping a substrate 317 from a fuser belt 303, according to one embodiment. In one embodiment, the belt-roll fuser 300 performs the process 600 by way of a control module implemented in, for instance, a chip set including a processor and a memory as shown in FIG. 7. In step 601, the belt-roll fuser 300 defines a fusing nip 307 in the belt-roll fuser 300. The belt-roll fuser 300 may have, for example, a pressure member such as the IPR 301 and a fuser belt 303 that is entrained by the IPR 301. In the belt-roll fuser 300, a portion of the fuser belt 303 faces a surface of the IPR 301 at the fusing nip 307. The belt-roll fuser 300 may also have a another pressure member such as EPR 305, for example, that has a portion that faces a portion of the fuser belt 303 that is other than the portion of the fuser belt 303 that faces the surface of the IPR 301 at the fusing nip 307. Accordingly, the fuser belt 303 may be entrained between the IPR 301 and the EPR 305. The belt-roll fuser 300 may also include a deformation member, such as the bulge enhancing roll 309, configured to deform the IPR 301, for example, to induce a deformation in the IPR 301 so as to reduce or eliminate the N3 region discussed above in FIG. 2.

The process continues to step 603 in which the belt-roll fuser 300 causes, at least in part, the bulge enhancing roll 309 to induce the deformation 310 in the IPR 301.

Next, in step 605, the belt-roll fuser 300 optionally causes, at least in part, the bulge enhancing roll 309 to treat the fuser belt 303 with a maintenance conditioner and/or clean the fuser belt 303. Then, in step 607, the deformation control member 311 may optionally be caused to exert a predetermined pressure on the bulge enhancing roll 309 in a direction toward the IPR 301 at the deformation nip 308. The predetermined pressure may be an amount that is customizable to enable a selectable stripping radius R2 based on the magnitude of the deformation 310. Then, in step 609, the belt-roll fuser 300 strips the substrate 317 from the fuser belt 303. The belt-roll fuser 300 may use the air knife 313 to cause the stripping to occur.

FIG. 7 illustrates a chip set or chip 700 upon which an embodiment of the invention may be implemented. Chip set 700 is programmed control the magnitude of a bulge radius as described herein and includes, for instance, a processor and memory components incorporated as one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 700 can be implemented in a single chip. It is further contemplated that in certain embodiments the chip set or chip 700 can be implemented as a single "system on a chip." It is further contemplated that in certain embodiments a separate ASIC would not be used, for example, and that all relevant functions as disclosed herein would be performed by a processor or processors. Chip set or chip 700, or a portion thereof, constitutes an example means for performing one or more steps of controlling the magnitude of a bulge radius.

In one embodiment, the chip set or chip 700 includes a communication mechanism such as a bus 701 for passing information among the components of the chip set 700. A processor 703 has connectivity to the bus 701 to execute instructions and process information stored in, for example, a memory 705. The processor 703 may include one or more processing cores with each core configured to perform independently. A multi-core processor enables multiprocessing within a single physical package. Examples of a multi-core processor include two, four, eight, or greater numbers of processing cores. Alternatively or in addition, the processor 703 may include one or more microprocessors configured in tandem via the bus 701 to enable independent execution of instructions, pipelining, and multithreading. The processor 703 may also be accompanied with one or more specialized components to perform certain processing functions and tasks such as one or more digital signal processors (DSP) 707, or one or more application-specific integrated circuits (ASIC) 709. A DSP 707 typically is configured to process real-world signals (e.g., sound) in real time independently of the processor 703. Similarly, an ASIC 709 can be configured to perform specialized functions not easily performed by a more general purpose processor. Other specialized components to aid in performing the functions described herein may include one or more field programmable gate arrays (FPGA), one or more controllers, or one or more other special-purpose computer chips.

In one embodiment, the chip set or chip 700 includes merely one or more processors and some software and/or firmware supporting and/or relating to and/or for the one or more processors.

The processor 703 and accompanying components have connectivity to the memory 705 via the bus 701. The memory 705 includes both dynamic memory (e.g., RAM, magnetic disk, writable optical disk, etc.) and static memory (e.g., ROM, CD-ROM, etc.) for storing executable instructions that when executed perform the steps described herein to control the magnitude of a bulge radius. The memory 705 also stores any data associated with or generated by the execution of the steps discussed herein.

While the above apparatuses, methods and systems for controlling nip geometry are described in relationship to exemplary embodiments, many alternatives, modifications, and variations would be apparent to those skilled in the art. Accordingly, embodiments of apparatuses, methods and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An apparatus useful in printing comprising:

a first pressure member;

a fuser belt having a portion that faces a surface of the first pressure member at a region defining a fusing nip;

a second pressure member that faces another portion of the fuser belt at the fusing nip such that the fuser belt is entrained between the first pressure member and the second pressure member; and a deformation member having a portion in contact with the first pressure member at a region defining a deformation nip to deform the first pressure member to control the fusing nip; wherein the deformation member applies varying pressure to alter the degree of deformation of the first pressure member.

2. The apparatus of claim 1, wherein the deformation caused by the deformation member is a bulge having a predetermined radius.

3. The apparatus of claim 2, wherein the deformation member is a roll.

4. The apparatus of claim 2, wherein the deformation member is a shoe.

5. The apparatus of claim 2, wherein the deformation member is coated with a friction reducing coating.

6. The apparatus of claim 1, wherein the first pressure member is an internal pressure roll that may be adjustable to adjust a magnitude of deformation, and the deformation nip is positioned downstream of the fusing nip in a process direction.

7. The apparatus of claim 1, wherein the fuser belt has a portion that faces a surface of the first pressure member at a region defined by the deformation nip, the deformation nip is positioned downstream of the fusing nip in a process direction, the deformation member faces another portion of the fuser belt at the deformation nip, and the fuser belt is entrained between the first pressure member and the deformation member at the deformation nip.

8. The apparatus of claim 1, wherein the first pressure member comprises a material that is softer than a material of the second pressure member and a material of the deformation member.

9. The apparatus of claim 1, wherein the deformation member is movable and the apparatus further comprises:

a deformation control element configured to cause the deformation member to vary a degree of the deformation on demand.

10. The apparatus of claim 1, wherein the deformation member is configured to treat the fuser belt with a maintenance conditioner.

11. A method for stripping a substrate in a printing process comprising:

defining a fusing nip in an apparatus useful in printing, the apparatus comprising:

a first pressure member;

a fuser belt having a portion that faces a surface of the first pressure member at the fusing nip;

a second pressure member that faces another portion of the fuser belt at the fusing nip such that the fuser belt is entrained between the first pressure member and the second pressure member; and a deformation member having a portion in contact with the first pressure member at a region defining a deformation nip to deform the first pressure member to control the fusing nip;

causing, at least in part, the deformation member to apply varying pressure to induce a predetermined deformation in the first pressure member; and causing, at least in part, stripping of the substrate from the fuser belt.

12. The method of claim 11, wherein the deformation caused by the deformation member is a bulge having a predetermined radius.

13. The method of claim 12, wherein the deformation member is a roll.

14. The method of claim 12, wherein the deformation member is a shoe.

15. The method of claim 11, wherein the first pressure member is an internal pressure roll that may be adjustable to adjust a magnitude of deformation the deformation nip is positioned downstream of the fusing nip in a process direction.

16. The method of claim 11, wherein the fuser belt has a portion that faces a surface of the first pressure member at a region defining the deformation nip, the deformation nip is positioned downstream of the fusing nip in a process direction, the deformation member faces another portion of the fuser belt at the deformation nip, and the fuser belt is entrained between the first pressure member and the deformation member at the deformation nip.

17. The method of claim 11, wherein the first pressure member comprises a material that is softer than a material of the second pressure member and a material of the deformation member.

18. The method of claim 11, wherein the deformation member is movable and the method further comprises:

causing, at least in part, the deformation to be varied on demand by a deformation control element.

19. The method of claim 11 further comprising:

causing, at least in part, the deformation member to treat the fuser belt with a maintenance conditioner.

20. A system useful in printing configured to strip a substrate, the system comprising:

a first pressure member;

a fuser belt having a portion that faces a surface of the first pressure member at the fusing nip;

a second pressure member that faces another portion of the fuser belt at the fusing nip such that the fuser belt is entrained between the first pressure member and the second pressure member; and a deformation member having a portion in contact with the first pressure member at a region defining a deformation nip to deform the first pressure member to control the fusing nip, wherein the deformation member applies varying pressure to alter the degree of deformation of the first pressure member, wherein the deformation nip is positioned downstream of the fusing nip in a process direction and the deformation member is coated with a friction reducing coating, wherein the substrate is stripped from the fuser belt at a position downstream of the fusing nip in a process direction.

* * * * *